US006296455B1

(12) United States Patent
Backer et al.

(10) Patent No.: US 6,296,455 B1
(45) Date of Patent: Oct. 2, 2001

(54) PUMP ENABLE SYSTEM AND METHOD

(75) Inventors: Robert D. Backer, Rouzerville, PA (US); David Alan Hall, Hagerstown, MD (US); Robert William Johnston, Greencastle, PA (US)

(73) Assignee: Grove U.S. L.L.C., Shady Grove, PA (US)

( * ) Notice: Subject to any disclaimer, the term of this patent is extended or adjusted under 35 U.S.C. 154(b) by 0 days.

(21) Appl. No.: 09/245,284

(22) Filed: Feb. 5, 1999

Related U.S. Application Data

(60) Provisional application No. 60/074,336, filed on Feb. 6, 1998.

(51) Int. Cl.[7] ..... F04B 49/00

(52) U.S. Cl. ..... 417/213; 417/218

(58) Field of Search ..... 417/213, 212, 417/222, 218, 219; 60/445

(56) References Cited

U.S. PATENT DOCUMENTS

| | | | | |
|---|---|---|---|---|
| 2,403,371 | | 4/1946 | Ifield et al. . | |
| 3,733,963 | | 5/1973 | Kubilos . | |
| 3,768,928 | * | 10/1973 | Miller et al. | 417/213 |
| 3,834,836 | | 9/1974 | Hein et al. . | |
| 3,935,706 | | 2/1976 | Stevens . | |
| 3,942,413 | * | 3/1976 | Schwary et al. | 91/518 |
| 4,081,223 | | 3/1978 | Fricke et al. . | |
| 4,349,319 | * | 9/1982 | Byers, Jr. et al. | 417/222 |
| 4,476,680 | | 10/1984 | Pollman et al. . | |
| 4,518,320 | | 5/1985 | Goodell . | |
| 5,190,445 | | 3/1993 | Ikari . | |

FOREIGN PATENT DOCUMENTS

| | | |
|---|---|---|
| 0367476A1 | 5/1990 | (EP) . |
| 0773370A1 | 5/1997 | (EP) . |
| 1582453 | 1/1981 | (GB) . |
| 51-70503 | 6/1976 | (JP) . |
| 53-5365 | 1/1978 | (JP) . |
| 62-121879 | 6/1987 | (JP) . |
| 2286963 | 11/1990 | (JP) . |
| 454978 | 5/1992 | (JP) . |
| 596471 | 12/1993 | (JP) . |

* cited by examiner

*Primary Examiner*—Teresa Walberg
*Assistant Examiner*—Thor Campbell

(57) ABSTRACT

A pump enable system includes a variable-displacement piston pump having a displacement control device. The displacement control device controls displacement of pistons in the pump based on a position thereof, and a position control system in the pump controls a position of the displacement control device based on a load on the pump. An over-ride system selectively over-rides the position control system such that the displacement control device assumes a position which reduces displacement of the pistons in the pump.

15 Claims, 7 Drawing Sheets

PUMP ENABLE SYSTEM AND METHOD

This application claims priority on provisional application Serial No. 60/074,336 filed on Feb. 6, 1998, the entire contents of which are hereby incorporated by reference.

BACKGROUND OF THE INVENTION

1. Field of the Invention

The present invention relates to a pump enable system and method; and more particularly, a pump enable system and method for variable-displacement piston pumps.

2. Description of Related Art

FIG. 1 schematically illustrates a well-known variable-displacement piston pump 10 such as Vickers Incorporated's Model No. PVE19R930CVPC. The piston pump 10 includes a pump 12 having a plurality of pistons (not shown). The pump 12 is connected between a suction line 14 and a pressure line 16, and is driven by an engine 18. Oil leaking in the pump 12 is drained via a drain line 20.

As is well-known, a swash plate 22 (also known as a wobble plate), connected to the pistons in the pump 12, controls the displacement of the pistons; and thus, the flow rate of the pump 12. More specifically, the position of the swash plate 22 determines the displacement of the pistons in the pump 12. A servo piston 24 controls the movement of the swash plate 22 based on hydraulic pressure (i.e., fluid) supplied thereto.

As shown in FIG. 1, a pressure compensation valve 26 and a flow compensation valve 28 cooperatively regulate the supply of hydraulic pressure generated by the pump 12 to the servo piston 24 based on the hydraulic pressure in a load sense line 30. The load sense line 30, for instance, is connected to a directional control valve (not shown), which when placed in a state requiring hydraulic pressure supplies hydraulic pressure to the load sense line 30. Both the pressure and flow compensation valves 26 and 28 are two-state valves.

When a load is placed on the pump 12, the pressure compensation valve 26 and the flow compensation valve 28 are both placed in a first state as shown in FIG. 1. In this first state, the hydraulic pressure generated by the pump 12 is not supplied to the servo piston 24, and the servo piston 24 is connected with the drain line 20 to remove hydraulic pressure therefrom. As a result, the servo piston 24 retracts and the swash plate 22 moves to an inclined position, which increases the displacement of the pistons in the pump 12 and increases the flow rate of the pump 12.

When no load is placed on the pump 12, the pressure compensation valve 26 and the flow compensation valve 28 both attain a second state. While not shown as being in the second state, FIG. 1 does illustrate the second states of the pressure and flow compensation valves 26 and 28. In this second state, the hydraulic pressure generated by the pump 12 is supplied to the servo piston 24. As a result, the servo piston 24 extends and moves the swash plate 22 to a more vertical position, which reduces the piston displacement in the pump 12 and decreases the flow rate of the piston pump 12. When fully stroked, the servo piston 24 moves the swash plate 22 to a position which reduces the hydraulic pressure generated by the pump 12 to a stand-by pressure.

Whether the pressure and flow compensation valves 26 and 28 are placed in the first or second state depends on the hydraulic pressure in the load sense line 30 and the pressure line 16. Namely, the hydraulic pressure generated by pump 12 is supplied to first control inputs 40 and 44 of the pressure compensation valve 26 and the flow compensation valve 28, respectively, and the hydraulic pressure in the load sense line 30 is supplied to a second control input 42 of the pressure compensation valve 26. First and second springs 45 and 46 bias the pressure and flow compensation valves 26 and 28, respectively, to the right in FIG. 1.

When no load is placed on the load sense line 30, the hydraulic pressure generated by the pump 12 causes the pressure and flow compensation valves 26 and 28 to move to the left in FIG. 1 (i.e., the second state). However, when a load is placed on the load sense line 30, the hydraulic pressure applied to the second control input 42 of the pressure compensation valve 26 causes the pressure compensation valve 26 to move to the right (i.e., the first state). As a result, the hydraulic pressure applied to the first control input 44 of the flow compensation valve 28 is exhausted to the drain line 20 via the pressure compensation valve 26, and the flow compensation valve 28 moves to the right (i.e., the first state).

The hydraulic pressure generated by the pump 12 and supplied via the pressure line 16 typically powers hydraulically operated machinery. As discussed above, the variable-displacement piston pumps 10 can be connected to a directional control valve. The directional control valve applies hydraulic pressure to the load sense line 30 depending on the need for hydraulic pressure from the variable-displacement piston pump 10. Unfortunately, if the directional control valve sticks in an open state for operating machinery connected thereto when an operator wants the directional control valve closed, the variable-displacement piston pump 10 continues to supply hydraulic pressure.

As such, it is desirable, such as in emergency conditions, to immediately stop operation of that machinery. Often this is accomplished by removing the supply of hydraulic pressure necessary to operate the machinery. FIG. 1 illustrates a conventional dump system for removing the supply of hydraulic pressure.

As shown in FIG. 1, a dump valve 32 is connected between the pressure line 16 and a reservoir 34. In a closed state, the dump valve 32 prevents hydraulic pressure from flowing to the reservoir 34 from the pressure line 16. However, in an open state, as shown in FIG. 1, the dump valve 32 permits hydraulic pressure to flow to the reservoir 34, which substantially eliminates hydraulic pressure in the pressure line 16. By placing the dump valve 32 in the open state, operation of machinery utilizing the hydraulic pressure in the pressure line 16 can be brought to a halt.

FIG. 2 schematically illustrates another well-known variable-displacement piston pump 110 such as Parker Hannifin Corporations Model No. PAVC65X29948. The piston pump 110 includes a pump 112 having a plurality of pistons (not shown). The pump 112 is connected between a suction line 114 and a pressure line 116, and is driven by an engine 118. Oil leaking in the pump 112 is drained via a drain line 120.

As is well-known, a swash plate 122, connected to the pistons in the pump 112, controls the displacement of the pistons; and thus, the flow rate of the pump 112. More specifically, the position of the swash plate 122 determines the displacement of the pistons in the pump 112. A servo piston 124 controls the movement of the swash plate 122 based on hydraulic pressure (i.e., fluid) supplied thereto.

As shown in FIG. 2, a differential adjustment valve 126 regulates the supply of hydraulic pressure generated by the pump 112 to the servo piston 124 based on the hydraulic pressure in a load sense line 130. The load sense line 130, for instance, is connected to a directional control valve (not shown), which when placed in a state requiring hydraulic pressure supplies hydraulic pressure to the load sense line 130.

The differential adjustment valve 126 is a two-state valve. When no load is placed on the pump 110, the differential adjustment valve 126 is placed in a first state. While FIG. 2 does not illustrate the differential adjustment valve 126 in the first state, FIG. 2 does illustrate the first state. Specifically, because no hydraulic pressure is supplied to the control input 140 of the differential adjustment valve 126 by the load sense line 130, a spring 142 biases the differential adjustment valve 126 down in FIG. 2 (i.e., biases the differential adjustment valve 126 towards the first state). This connects the servo piston 124 to the drain line 120, and hydraulic pressure at the servo piston 124 exhausts via the drain line 120. As a result, the servo piston 124 retracts and moves the swash plate 122 to a more vertical position, which reduces the piston displacement in the pump 112 and decreases the flow rate of the pump 112. When fully retracted, the servo piston 124 moves the swash plate 122 to a position which reduces the hydraulic pressure generated by the pump 112 to a stand-by pressure.

When a load is placed on the pump 110, the differential adjustment valve 126 is placed in a second state as shown in FIG. 2. Namely, when a load is placed on the pump 110, hydraulic pressure is applied to the control input 142 of the differential adjustment valve 126 by the load sense line 130. This hydraulic pressure causes the differential adjustment valve 126 to move up in FIG. 2 (i.e., move towards the second state). In this second state, the pressure line 116 is connected to the servo piston 124, and hydraulic pressure is supplied to the servo piston 124. As a result, the servo piston 124 extends and the swash plate 122 moves to an inclined position, which increases the displacement of the pistons in the pump 112 and increases the flow rate of the pump 112.

The hydraulic pressure generated by the pump 112 and supplied via the pressure line 116 typically powers hydraulically operated machinery in the same manner discussed above with respect to the variable-displacement piston pump 10 of FIG. 1. As such it is desirable, such as in emergency conditions, to immediately stop operation of that machinery As shown in FIG. 2, a dump valve 132 is connected between the pressure line 116 and a reservoir 134. In a closed state, the dump valve 132 prevents hydraulic pressure from flowing to the reservoir 134 from the pressure line 116. However, in an open state, as shown in FIG. 2, the dump valve 132 permits hydraulic pressure to flow to the reservoir 134, which substantially eliminates hydraulic pressure in the pressure line 116. By placing the dump valve 132 in the open state, operation of machinery utilizing the hydraulic pressure in the pressure line 116 can be brought to a halt.

In the dump systems of FIGS. 1 and 2, the immediate elimination of hydraulic pressure in the pressure line 116 causes a significant shock or jolt. Furthermore, this immediate elimination of hydraulic pressure defeats the benefits provided by systems incorporating a ramp down feature. Systems incorporating a ramp down feature include hydraulic elements which gradually reduce their demand for hydraulic pressure such that the hydraulic pressure supplied by the variable-displacement piston pump 10 or 110, in response to this demand, gradually decreases. Consequently, machinery operating based on the hydraulic pressure supplied by the variable-displacement piston pump 10 or 110 gradually comes to a halt.

SUMMARY OF THE INVENTION

The pump enable system according to the present invention comprises: a variable-displacement piston pump having a displacement control device, said displacement control device controlling displacement of pistons in said pump based on a position thereof, and position control system for controlling a position of said displacement control device based on a load on said pump; and an over-ride system for selectively over-riding said position control system such that said displacement control device assumes a position which reduces displacement of said pistons in said pump.

The method of enabling a variable-displacement piston pump according to the present invention, in which said pump includes a displacement control device controlling displacement of pistons in said pump based on a position thereof and position control system for controlling a position of said displacement control device based on a load on said pump, comprises: selectively over-riding said position control system such that said displacement control device assumes a position which reduces displacement of said pistons in said pump.

By controlling the displacement control device, as opposed to exhausting hydraulic pressure supplied by the pump, the pump enable system and method according to the present invention significantly reduces the pressure supplied by the variable-displacement pump without causing a shock or jolt.

In at least one embodiment of the pump enable system and method according to the present invention, over-riding the position control system is delayed to prevent defeating the ramp down feature.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
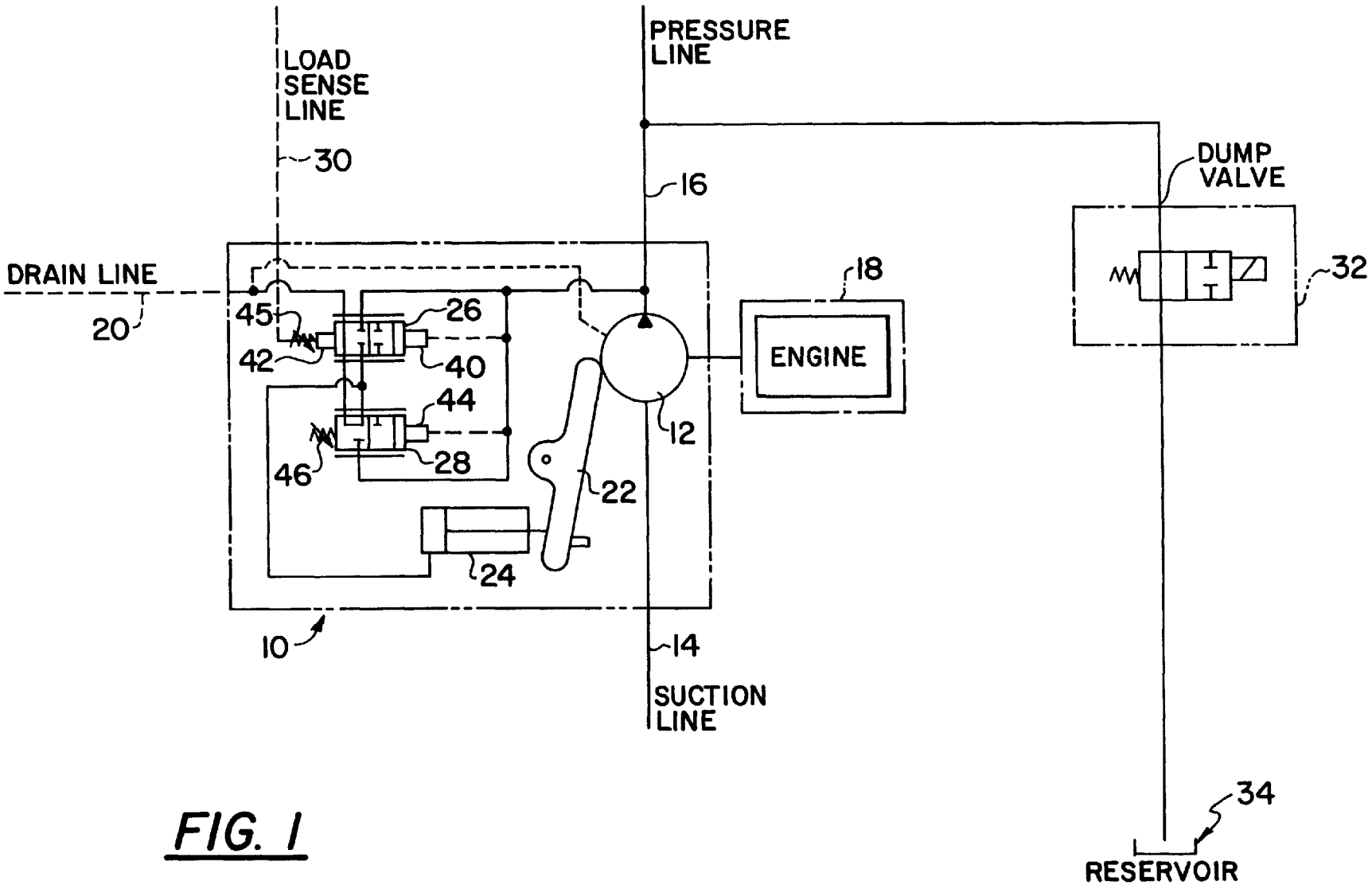
FIG. 1 schematically illustrates a prior art variable-displacement piston pump with a dump system.
Figure 3:
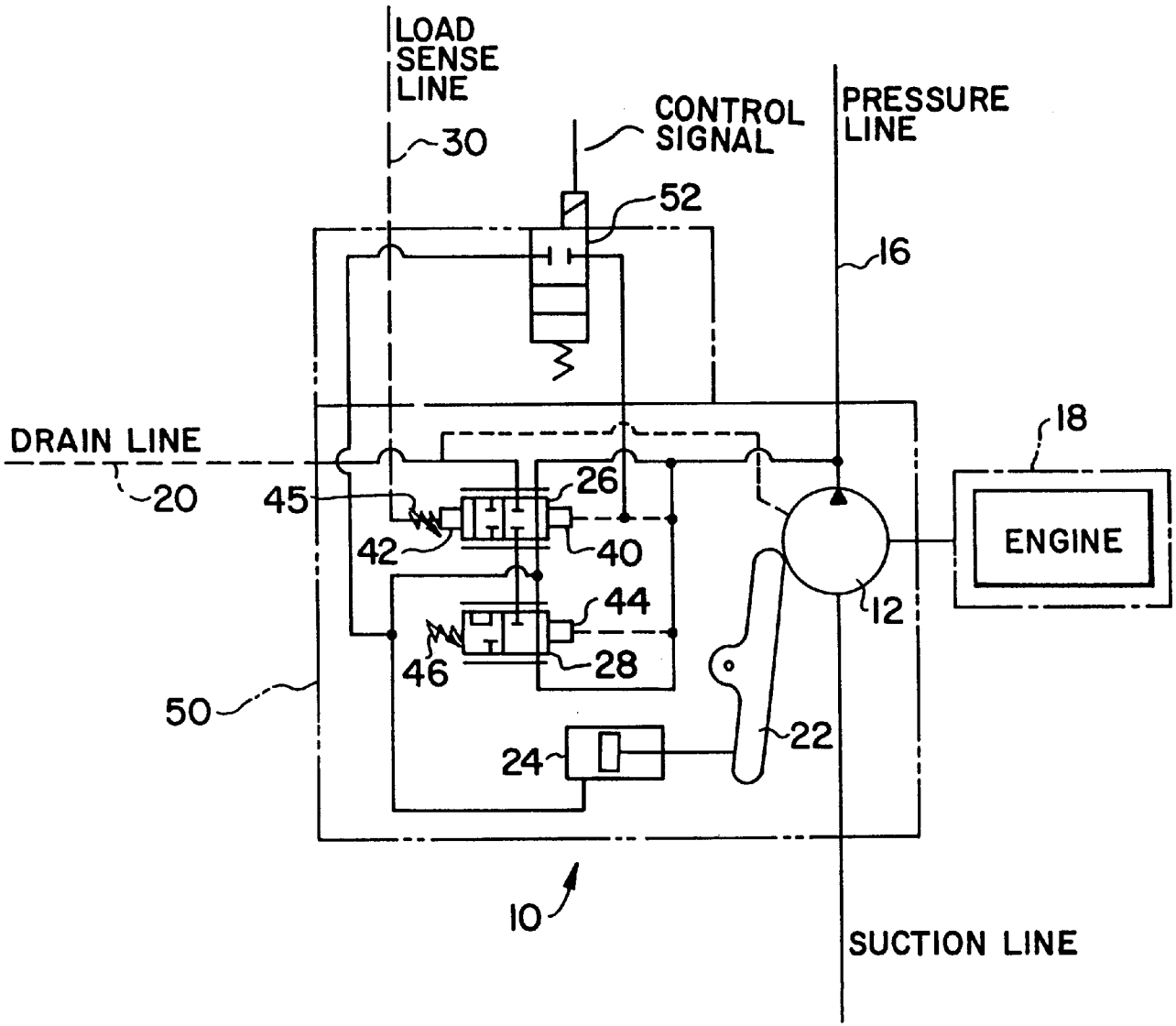
FIG. 3 schematically illustrates a first embodiment of the pump enable system according to the present invention in a first state.

FIG. 3 schematically illustrates a first embodiment of the pump enable system according to the present invention in a first state. As shown in FIG. 3, the pump enable system according to the first embodiment includes the variable-displacement piston pump 10 discussed in detail above with respect to FIG. 1. Accordingly, the description of this variable-displacement piston pump will not be repeated.

As further shown in FIG. 3, the housing 50 of the variable-displacement piston pump 10 has been modified to include a solenoid valve 52. The solenoid valve 52 is connected between the first control input 40 of the pressure compensation valve 26 and the servo piston 24. The solenoid valve 52 has a closed state which prevents hydraulic pressure from flowing to the servo piston 24 from the first control input 40, and an open state which allows hydraulic pressure to flow from the first control input 40 to the servo piston 24. The solenoid valve 52 assumes either the open or closed state based on a received control signal.

Figure 4:
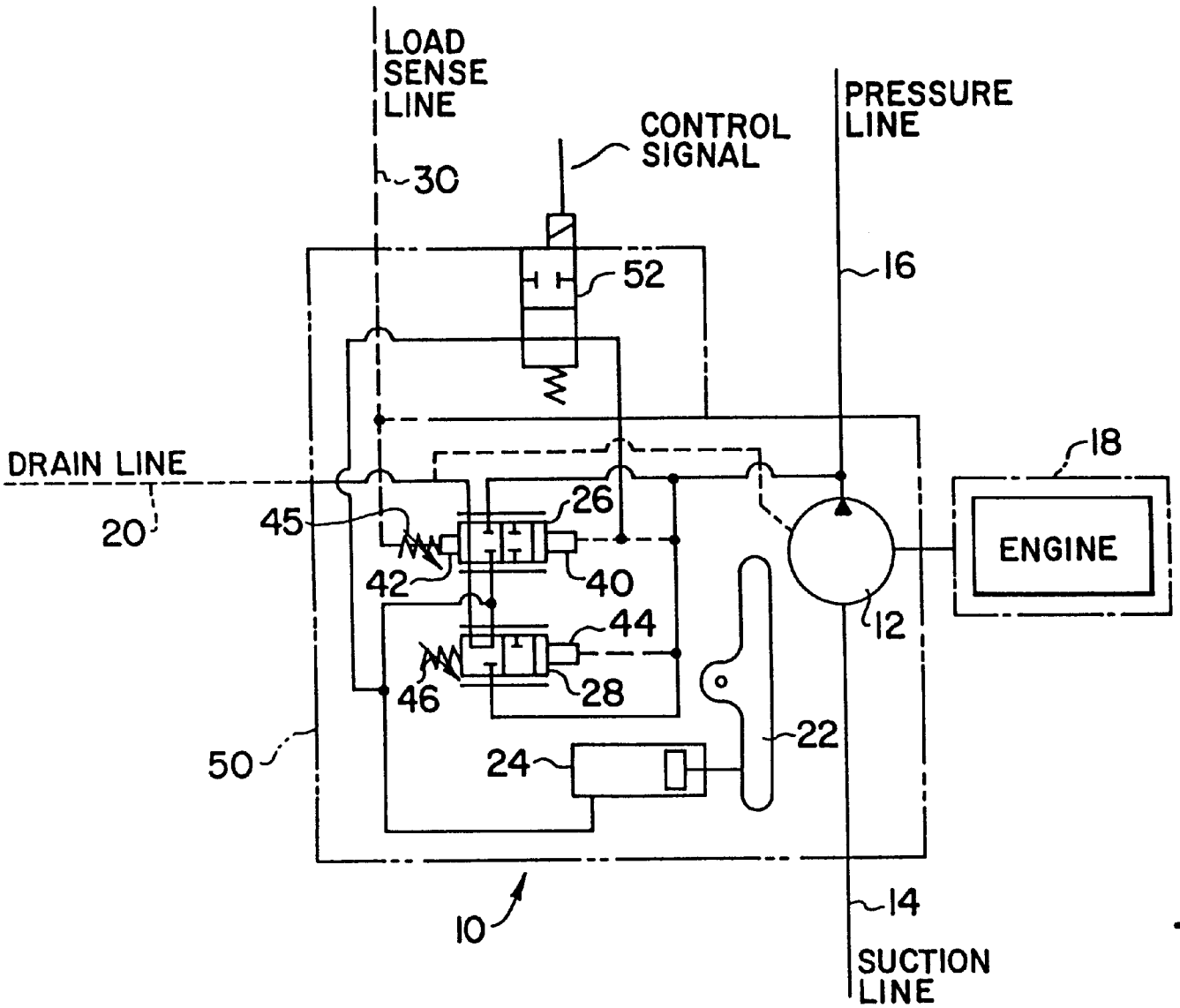
FIG. 4 schematically illustrates a first embodiment of the pump enable system according to the present invention in a second state.

When the solenoid valve 52 is placed in the closed state as shown in FIG. 3, the variable-displacement piston pump 10 operates in the conventional manner. When, however, the solenoid valve 52 is placed in the open state as shown in FIG. 4, the hydraulic pressure at the first control input 40 of the pressure compensation valve 26 (i.e., the hydraulic pressure generated by the pump 12) flows to the servo piston 24 via the solenoid valve 52.

Figure 2:
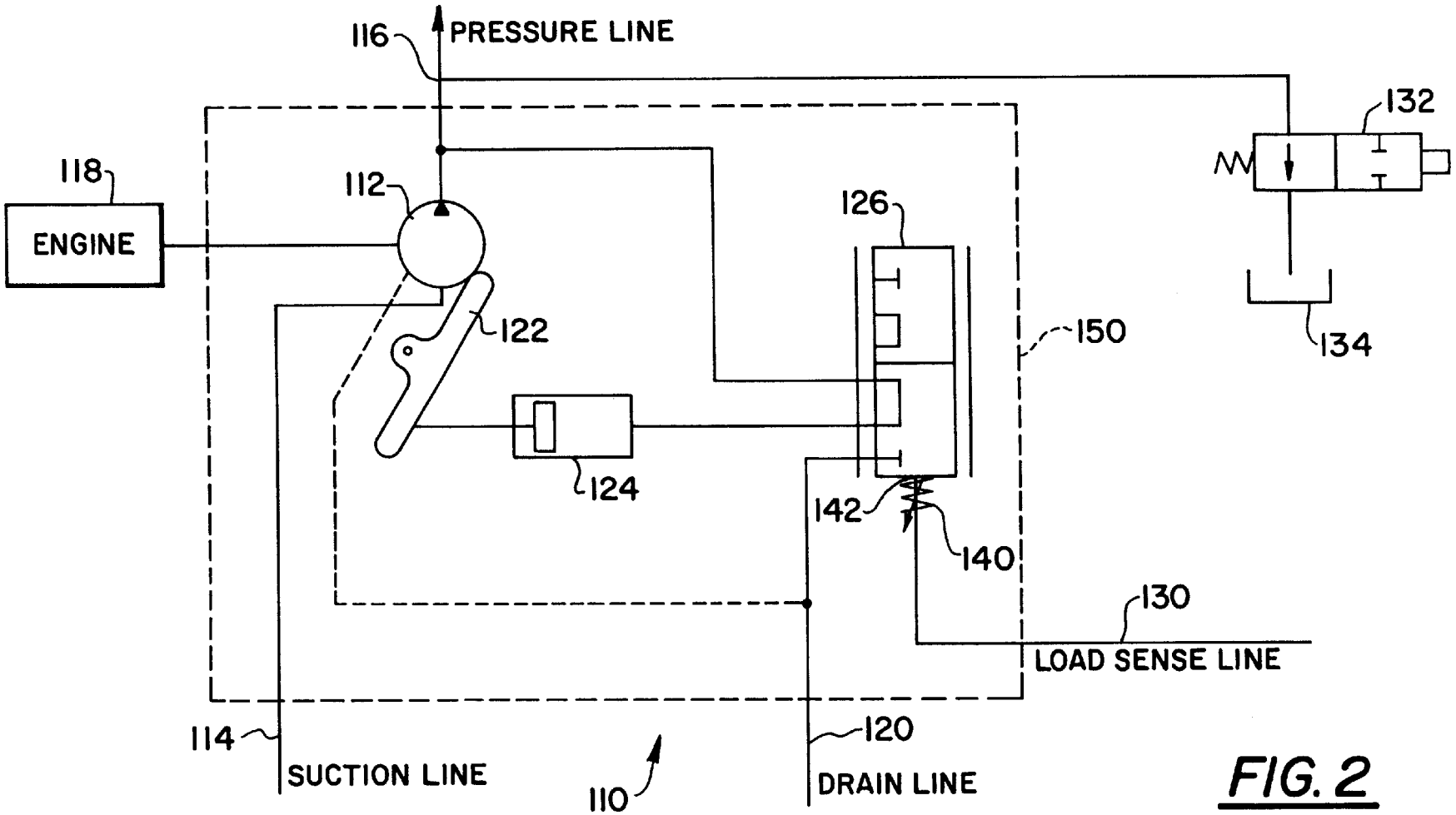
FIG. 2 schematically illustrates another prior art variable-displacement piston pump with a dump system.

Even if the servo piston 24 is connected with the drain line 20 via the pressure and flow compensation valves 26 and 28 as shown in FIG. 2, this connection to the drain line 20 can not sufficiently exhaust the hydraulic pressure being supplied via the solenoid valve 52 to prevent the servo piston 24 from extending. As a result, the servo piston 52 extends and the swash plate 22 moves and reduces the displacement of the pistons in the pump 12. This causes a reduction in the flow rate of the pump 12. Specifically, the swash plate 22 reduces the displacement of the pistons in the pump 12 such that the pump 12 can not generate hydraulic pressure above 150 PSI. Hydraulic pressure below 150 PSI is insufficient to operate machinery, but the shock or jolt experienced in prior art pump enable systems is substantially eliminated.

Furthermore, when de-energized, the solenoid valve 52 is in the open state. Unless the solenoid valve 52 is energized, the variable-displacement piston pump 10 does not generate a hydraulic pressure above 150 PSI. Accordingly, even if, for example, the directional control valve to which the variable-displacement piston pump 10 is connected sticks in the open state, undesired operation of machinery does not occur.

As an alternative embodiment, the solenoid valve 52 is connected externally to the variable-displacement piston pump 10.

Figure 5:
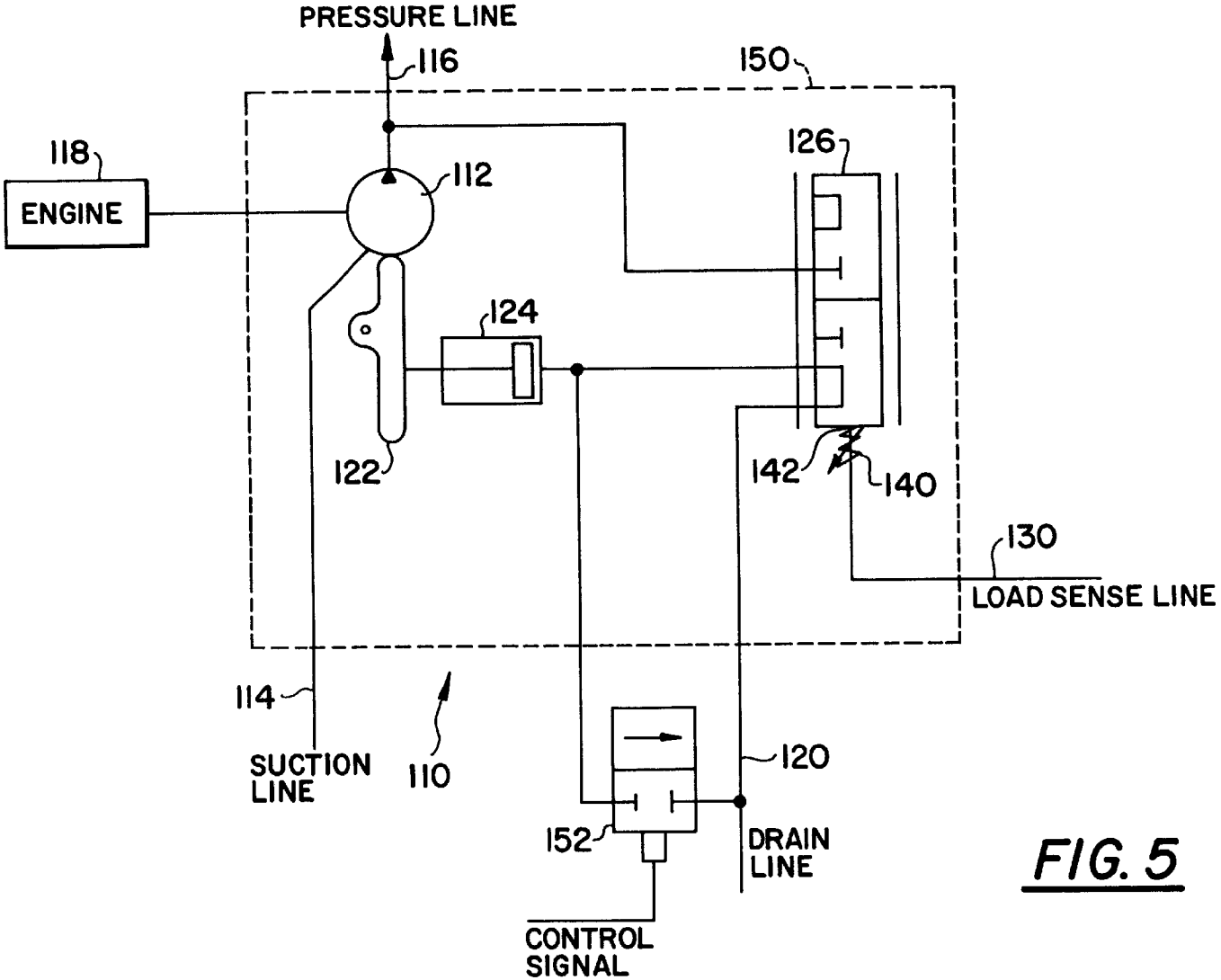
FIG. 5 schematically illustrates a second embodiment of the pump enables system according to the present invention in a first state.

FIG. 5 schematically illustrates another embodiment of the pump enable system according to the present invention in a first state. As shown in FIG. 5, the pump enable system according to this embodiment includes the variable-displacement piston pump 110 discussed in detail above with respect to FIG. 2. Accordingly, the description of this variable-displacement piston pump 110 will not be repeated.

As further shown in FIG. 5, a solenoid valve 152, external to the housing 150 of the variable-displacement piston pump 110, is connected to the variable-displacement piston pump 110. Specifically, the solenoid valve 152 is connected between the servo piston 124 and the drain line 120. The solenoid valve 152 has a closed state which prevents hydraulic pressure from flowing to the drain line 120 from the servo piston 124, and an open state which allows hydraulic pressure to flow from the servo piston 124 to the drain line 120. The solenoid valve 152 assumes either the open or closed state based on a received control signal.

Figure 6:
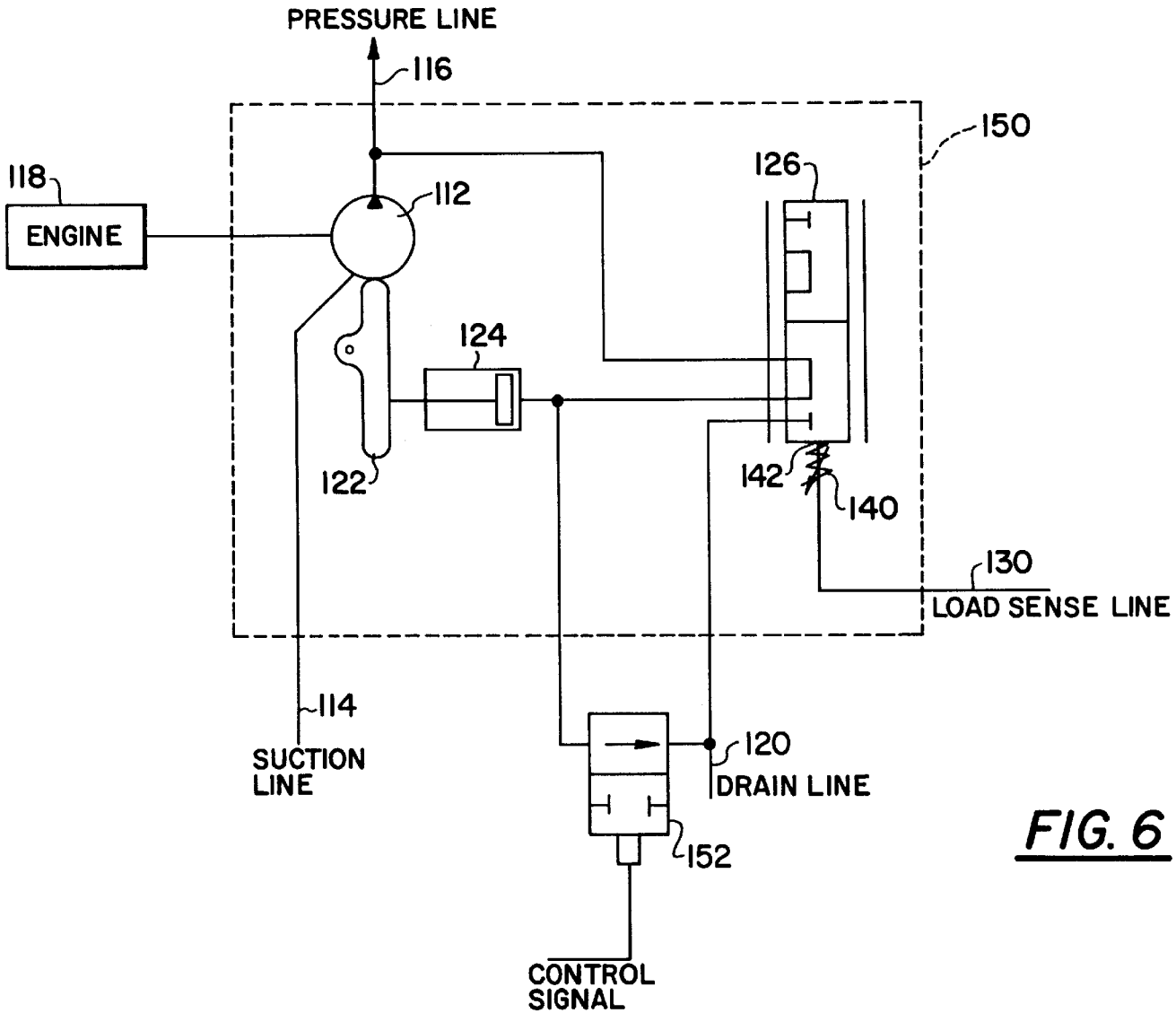
FIG. 6 schematically illustrates a second embodiment of the pump enable system according to the present invention in a second state.

When the solenoid valve 152 is placed in the closed state as shown in FIG. 5, the variable-displacement piston pump 110 operates in the conventional manner. When, however, the solenoid valve 152 is placed in the open state as shown in FIG. 6, the hydraulic pressure at the servo piston 124 flows to the drain line 120 via the solenoid valve 152.

The hydraulic pressure at the servo piston 124 exhausts to the drain line 120 via the solenoid valve 152 regardless of the state of the differential adjustment valve 126. For instance, as shown in FIG. 6, even if the differential adjustment valve 126 is in the second state for supplying hydraulic pressure to the servo piston 124, when the solenoid valve 152 is in the open state, hydraulic pressure exhausts from the servo piston 124 to the drain line 120.

As a result, the servo piston 124 retracts and the swash plate 122 moves to reduce the displacement of the pistons in the pump 112. This causes a reduction in the flow rate of the pump 112. Specifically, the swash plate 122 reduces the displacement of the pistons in the pump 112 such that the pump 112 can not generate hydraulic pressure above 150 PSI. Hydraulic pressure below 150 PSI is insufficient to operate machinery, but the shock or jolt experienced in prior art pump enable systems is substantially eliminated.

Furthermore, when de-energized, the solenoid valve 152 is in the open state. Unless the solenoid valve 152 is energized, the variable-displacement piston pump 110 does not generate a hydraulic pressure above 150 PSI. Accordingly, even if, for example, the directional control valve to which the variable-displacement piston pump 110 is connected sticks in the open state, undesired operation of machinery does not occur.

As an alternative embodiment, the housing 150 of the variable-displacement piston pump 110 is modified to include the solenoid valve 152.

Figure 7:
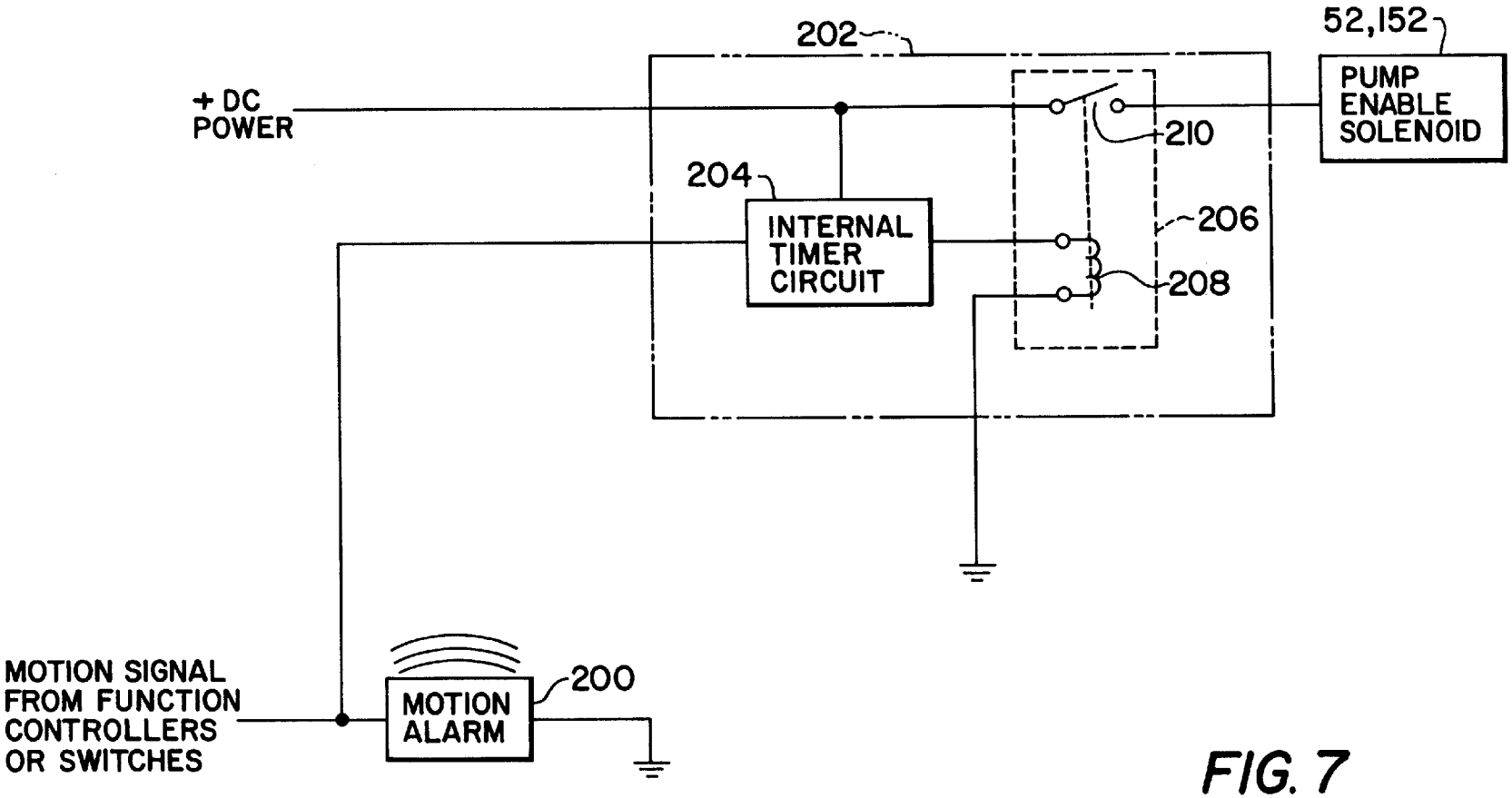
FIG. 7 illustrates a control circuit for the solenoid valve in the pump enable system according to the present invention.

FIG. 7 illustrates a control circuit for the solenoid valve 52 or 152 in the pump enable system according to the present invention. As shown, a motion signal from a function controller or switch is supplied to both a motion alarm 200 and delay timer 202. The delay timer 202 also receives a 12 volt power supply, and outputs the control signal to the solenoid valve 52 or 152.

The delay timer 202 includes an internal timer circuit 204 and a switching relay 206. The switching relay 206 includes a coil 208 and a switch 210. The coil 208 receives an output signal from the internal timer circuit 204. The switch 210 is connected between the 12 volt power supply and the solenoid valve 52 or 152. When the coil 208 is de-energized, the switch 210 is open, and when the coil 208 is energized, the switch 210 closes and provides a control signal to energize the solenoid valve 52 or 152.

When the motion alarm 200 receives a motion signal, the motion alarm 200 outputs an alarm. When the internal timer circuit 204 receives the motion signal, the internal timer circuit 204 counts to a predetermined period of time, and then energizes the coil 208. Accordingly, the switch 210 closes and energizes the solenoid valve 52 or 152.

When the motion signal is discontinued, the motion alarm 200 stops issuing the alarm and the internal timer circuit 204 de-energizes the coil 208 a predetermined period of time after the motion signal is discontinued. Once the coil is de-energized, the switch 210 opens and the solenoid valve 52 or 152 is de-energized.

Because of the delay timer 202, the solenoid valve 52 or 152 is energized or de-energized a predetermined period of time after the motion signal is issued or discontinued. This delay allows systems incorporating a ramp down feature and the pump enable system according to the present invention to enjoy the features of the ramp down system. Namely, the ramp down begins when the motion signal is discontinued, but the solenoid valve 52 or 152 is not de-energized until a predetermined period of time thereafter. Consequently, machinery operating based on the hydraulic pressure supplied by the variable-displacement piston pump 10 or 110 gradually comes to a halt.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pump enable system, comprising:

a variable-displacement piston pump having a displacement control device, said displacement control device controlling displacement of pistons in said pump based on a position thereof, and a position control system for controlling said position of said displacement control device based on a load on said pump; and an over-ride system for selectively over-riding said position control system such that said displacement control device assumes a position which reduces displacement of said pistons in said pump, said over-ride system including an electrically controlled valve that selectively redirects hydraulic pressure in said position control system such that said displacement control device assumes a position which reduces displacement of said pistons in said pump.

2. The pump enable system of claim 1, wherein the position control system comprises:

a servo piston controlling said position of said displacement control device; and a valve system controlling said servo piston based on said load on said pump.

3. The pump enable system of claim 2, wherein the over-ride system one of supplies hydraulic pressure to and exhausts hydraulic pressure from said servo piston so that said displacement control device assumes a position which reduces displacement of said pistons in said pump.

4. The pump enable system of claim 2, wherein said servo piston moves said displacement control device to a first position when supplied with hydraulic pressure, and moves said displacement control device to a second position when hydraulic pressure is exhausted therefrom; and said displacement of said pistons in said pump increases as said displacement control device moves to said first position, and said displacement of said pistons in said pump decreases as said displacement control device moves to said second position.

5. The pump enable system of claim 2, wherein said servo piston moves said displacement control device to a first position when supplied with hydraulic pressure, and moves said displacement control device to a second position when hydraulic pressure is exhausted therefrom; and said displacement of said pistons in said pump decreases as said displacement control device moves to said first position, and said displacement of said pistons in said pump increases as said displacement control device moves to said second position.

6. The pump enable system of claim 1, wherein said electrically controlled valve redirects hydraulic pressure in said position control system such that said displacement control device assumes a position which reduces displacement of said pistons in said pump when no control signal is received thereby.

7. The pump enable system of claim 1, wherein said over-ride system performs said over-ride when a control signal is no longer received thereby; and further including, a control signal supply circuit receiving a pressure request signal indicating a request for said pump to generate hydraulic pressure, and supplying said control signal to said over-ride system a predetermined period of time after receiving said pressure request signal.

8. The pump enable system of claim 7, wherein said control signal supply circuit continues to supply said control signal to said over-ride system for said predetermined period of time after no longer receiving said pressure request signal.

9. A method of enabling a variable-displacement pump, said pump including a displacement control device controlling displacement of pistons in said pump based on a position thereof and a position control system for controlling a position of said displacement control device based on a load on said pump, said method comprising:

selectively over-riding said position control system such that said displacement control device assumes a position which reduces displacement of said pistons in said pump, wherein said over-riding step includes operating an electrically controlled valve so as to selectively redirect hydraulic pressure in said position control system such that said displacement control device assumes a position which reduces displacement of said pistons in said pump.

10. The method of claim 9, wherein the over-riding step includes supplying hydraulic pressure to a servo piston, which controls said position of said displacement control device, in said position control system so that said displacement control device assumes a position which reduces displacement of said pistons in said pump.

11. The method of claim 9, wherein the over-riding step includes exhausting hydraulic pressure from a servo piston, which controls said position of said displacement control device, in said position control system so that said displacement control device assumes a position which reduces displacement of said pistons in said pump.

12. The method claim 9, wherein said over-riding step includes controlling a supply of a control signal to an over-ride system that selectively redirects hydraulic pressure in said position control system such that said displacement control device assumes a position which reduces displacement of said pistons in said pump.

13. The method of claim 12, wherein said over-ride system redirects hydraulic pressure in said position control system such that said displacement control device assumes a position which reduces displacement of said pistons in said pump when no control signal is received thereby.

14. The method of claim 13, wherein said controlling step comprises:

receiving a pressure request signal indicating a request for said pump to generate hydraulic pressure; and supplying said control signal to said over-ride system a predetermined period of time after receiving said pressure request signal.

15. The method of claim 14, wherein said controlling step further comprises:

supplying said control signal to said over-ride system for said predetermined period of time after no longer receiving said pressure request signal.

* * * * *